United States Patent [19]

Lee et al.

[11] 4,424,051

[45] Jan. 3, 1984

[54] METHOD AND APPARATUS FOR MANUFACTURING AN AGRICULTURAL BAG

[75] Inventors: Richard H. Lee; Steven R. Cullen, both of Astoria, Oreg.; Eddie H. Bailen, Omaha, Nebr.; David H. Rasmussen, Arlington, Nebr.; William C. Johnson, Omaha, Nebr.

[73] Assignee: Ag-Bag Corporation, Astoria, Oreg.

[21] Appl. No.: 342,842

[22] Filed: Jan. 26, 1982

Related U.S. Application Data

[63] Continuation of Ser. No. 37,882, May 10, 1979, abandoned.

[51] Int. Cl.[3] ..... B31B 23/02

[52] U.S. Cl. ..... 493/37; 493/217; 493/294; 493/302; 493/933; 493/967

[58] Field of Search ..... 493/217, 294, 297, 302, 493/933, 967, 231, 235, 239, 37, 22, 357, 410–412, 248; 53/170, 449–451, 551, 553, 554, 567, 576

[56] References Cited

U.S. PATENT DOCUMENTS

| | | | |
|---|---|---|---|
| 3,495,505 | 2/1970 | Hansson et al. | 493/302 |
| 3,553,924 | 1/1971 | Bonami | 53/576 X |
| 3,921,506 | 11/1975 | Hollis | 493/22 |
| 3,924,522 | 12/1975 | Martin | 493/297 X |
| 4,002,006 | 1/1977 | Bruno | 53/567 X |
| 4,027,460 | 6/1977 | Orr | 53/576 X |
| 4,340,379 | 7/1982 | Williamson | 493/967 X |

FOREIGN PATENT DOCUMENTS

| | | | |
|---|---|---|---|
| 766889 | 9/1967 | Canada . | |
| 460215 | 3/1975 | U.S.S.R. | 53/554 |

*Primary Examiner*—James F. Coan

[57] ABSTRACT

In a method and apparatus for manufacturing two-ply agricultural storage bags, two supplies (36, 38) of flexible tubular materials are positioned on opposite sides of feed wheels (26) mounted on a generally cylindrical frame structure (24). The inner material **(36*a*) from the first supply (36) extends through the frame (24) and outwardly around the feed wheels (26). The outer material (38*a*) from the second supply (38) extends around the feedwheels (26) in surrounding engagement over the inner material (36*a*). Actuation of the feedwheels (26) effects simultaneous advancement of the materials (36*a*, 38*a*) around the frame (24)** so that a bag can be collected at the lower end of the frame.

7 Claims, 8 Drawing Figures

METHOD AND APPARATUS FOR MANUFACTURING AN AGRICULTURAL BAG

This application is a continuation of Ser. No. 37,882, filed May 10, 1979, and now abandoned.

TECHNICAL FIELD

The present invention relates in general to an elongate container comprised of inner and outer layers. More particularly, this invention concerns a method and apparatus for manufacturing flexible containers for storing of agricultural products.

BACKGROUND ART

Traditionally, agricultural products such as hay, grain, silage, field crops and the like have been stored in covered structures. Barns, sheds, silos and other permanent structures erected near the fields in which the crops were grown are typically utilized for such purposes.

These permanent structures are generally weatherproof and provide secure storage for agricultural products, but several drawbacks exist in their use. In addition to the relatively high costs of constructing and maintaining these structures, specialized equipment is often required to load or unload agricultural products therefrom. Considerable labor is involved in handling and transporting the agricultural products between the fields and fixed storage facilities. In the case of crop rotation, for instance, a crop grown in a particular field may later be used to feed livestock grazing in that field. The use of remotely located storage structures thus involves unnecessary handling of the agricultural products, which is both time-consuming and expensive in terms of labor. Additionally, permanent storage structures are not generally sealed or airtight, contributing to shrinkage, spoilage and losses in nutritional value of the products stored therein.

More recently, temporary structures have been developed for storing agricultural products in the field. For example, long plastic bags have been used in conjunction with loader devices for in-field storage of agricultural products in the manner of horizontal silos, thereby eliminating the need for permanent storage facilities and the expenses associated therewith. These storage bags are generally not reusable, and are usually comprised of an inner liner and one or more outer layers up to 120 feet or more in length. Such plastic storage bags can be tightly sealed to reduce oxidation and thus preserve nutritional value of the agricultural products.

Heretofore, however, the construction of such bags has been a relatively complicated and costly process. There is thus a need for a novel method and apparatus for manufacturing agricultural storage bags with greater efficiency and at lower costs.

DISCLOSURE OF INVENTION

The present invention comprises a method and apparatus for manufacturing agricultural storage bags which overcomes the foregoing and other difficulties associated with the prior art. In accordance with the invention, a two-ply bag is formed from two supplies of flexible material in the form of tubes flattened and rolled onto the supply rolls. Plastic or other suitable flexible material can be used. The two supply rolls of tubular material are rotatably supported in spaced relationship with each tube extending toward a ring member. One of the tubes is fed through the ring and turned outwardly thereover, and the other tube is fed about the ring and over the first tube. The tubes are simultaneously advanced to form an agricultural storage bag of two-ply construction. Use of the present invention facilitates construction of a seamless, two-ply bag from supplies of tubular material which are readily available and conveniently handled.

In accordance with more specific aspects of the invention, there is provided a novel apparatus and method for manufacturing agricultural storage bags with greater efficiency and at lower cost. The apparatus of the invention includes a cylindrical frame structure resting upon a fixed table. The frame structure and table are surrounded by a fixed platform including a deck adjacent the upper end of the frame structure. A plurality of selectively driven feed wheels are mounted around the top of the cage structure.

Two supplies of tubular material are supported in vertically spaced relationship on opposite sides of the feed wheels on the frame structure. The supplies are preferably comprised of plastic or other suitable flexible material in the form of tubes flattened and wrapped into supply rolls. The lower supply is supported on the table or within the frame structure with the material therefrom extending upwardly through a circular guide and outwardly over the feed wheels. The upper supply is supported above the frame structure with the material therefrom extending downwardly around the feed wheels. Actuation of the feed wheels causes simultaneous advancement of the tubular materials around the frame structure to form a two-ply bag which is collected on the table. Elevation of the frame structure permits removal of the bag.

DESCRIPTION OF DRAWINGS

A more complete understanding of the invention can be had by reference to the following Detailed Description in conjunction with the accompanying Drawings, wherein.

DETAILED DESCRIPTION

Figure 1:
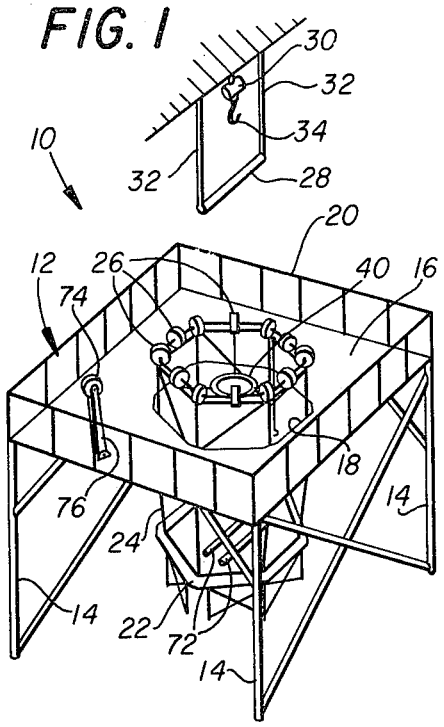
FIG. 1 is a perspective illustration of an apparatus for manufacturing agricultural storage bags in accordance with the invention.

Referring now to the Drawings, wherein like reference numerals designate like or corresponding parts throughout the several views, and particularly referring to FIG. 1, there is shown an apparatus 10 incorporating a first embodiment of the invention. Apparatus 10 is particularly suited for manufacturing two-ply, elongate bags for storing hay, grain, field crops, fodder, silage and other agricultural products in the field. Such storage bags serve as low-cost, nonreusable substitutes for barns, silos or other relatively expensive permanent structures. Use of apparatus 10 facilitates efficient construction of two-ply agricultural storage bags at less cost.

The agricultural storage bags constructed with apparatus 10 can be used with compaction devices such as that shown in application Ser. No. 37,882, filed 5/10/79 and entitled AGRICULTURAL BAG LOADING APPARATUS, which is assigned to the assignee hereof.

FIGS. 1–4 show the basic constructional details of apparatus 10 and illustrate the method of manufacturing agricultural storage bags accomplished thereby.

Apparatus 10 includes a platform 12 supported by four legs 14, only three of which are shown in FIG. 1. Legs 14 of platform 12 are preferably stabilized by diagonal braces as shown. Platform 12 includes an upper surface or deck 16 with a central opening 18 therein. A guard rail 20 is preferably provided around the periphery of deck 16 for the safety of personnel on platform 12. A ladder or stairway, neither of which are shown, can be used to climb onto platform 12.

Positioned below platform 12 is a table 22 supporting a frame 24, which extends upwardly through opening 18 in platform 12. Frame 24 comprises an elongate, cylindrical cage structure with a bottom end resting upon table 22 and an upper end positioned above deck 16 of platform 12. Opening 18 and frame 24 are dimensioned so that a space is left between frame 24 and deck 16, and to permit vertical movement of the frame relative to the platform, as will be more fully explained hereinafter.

A plurality of rollers or feed wheels 26 are mounted at the top of frame 24 in a generally circular, ring-like arrangement. As illustrated, frame 24 is hexagonal in cross section and twelve wheels 26 are employed in apparatus 10. Preferably, wheels 26 are arranged in a circle of about 9 feet diameter. Wheels 26 are mounted for rotation about substantially horizontal axes and are driven in unison to simultaneously feed tubular material from two supply rolls thereof during operation of apparatus 10.

An arbor 28 and a winch 30 are mounted about platform 12. Arbor 28 is suspended by members 32, which may be cables or rigid bars as desired. Winch 30 includes a hook 34, which can be selectively lowered or raised, and may be a conventional unit powered by an electric motor. Arbor 28 and winch 30 can be supported from any suitable structure, such as overhead beam or ceiling member. The basic components of apparatus 10 are thus shown in FIG. 1.

Figure 2:
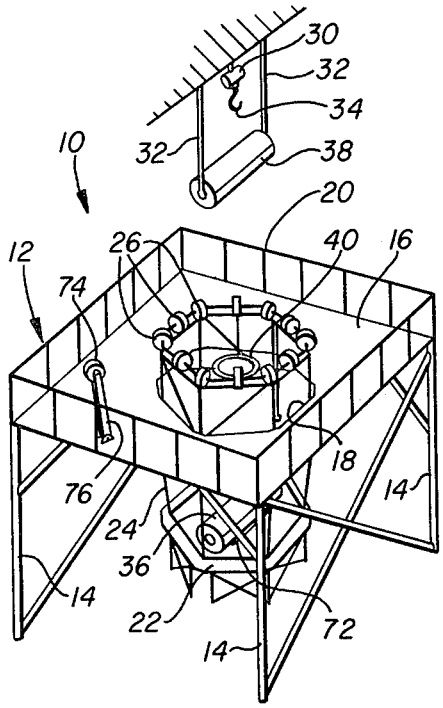
FIGS. 2–4 are perspective illustrations, partially cut away, showing the steps involved in manufacturing an agricultural storage bag in accordance with the apparatus and method of the invention herein.

To prepare apparatus 10 for operation, two supply rolls 36 and 38 are loaded as shown in FIG. 2. Lower supply roll 36 is rotatably supported below feed wheels 26 and preferably within frame 24. Lower supply roll 36 may be supported on an arbor (not shown) mountable within frame 24, or it may be rotatably supported on table 22 within the frame. Upper supply roll 38 is supported above feed wheels 26 on arbor 28.

Rolls 36 and 38 comprise lengths of tubular material flattened and rolled up, with circumferences substantially equal to the outside circumference of feed wheels 26. Tubular plastic material of suitable thickness and chemical composition is preferably employed. For instance, tubular plastic of about 9 feet diameter and 5 mil thickness can be used. In accordance with the preferred practice of the invention, lower roll 36 contains material suitable for a liner in an agricultural storage bag, which material may be, for example, black polyethylene to inhibit ultraviolet deterioration. The upper roll 38 contains material suitable for an outer layer of an agricultural storage bag, which material may be, for example, light plastic to reflect sunlight. Suitable tubular material in such roll form is readily available from several commercial sources.

Figure 3:
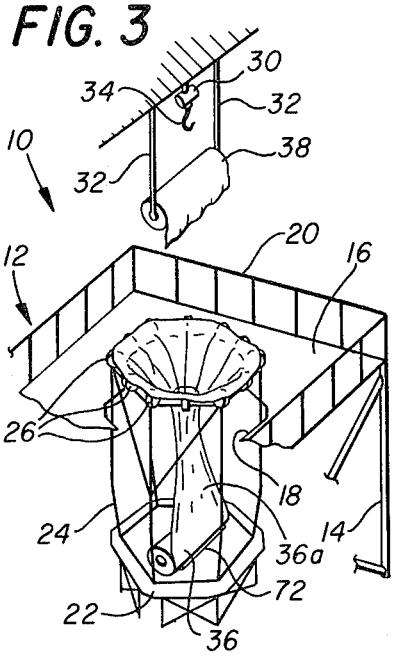
Figure 4:
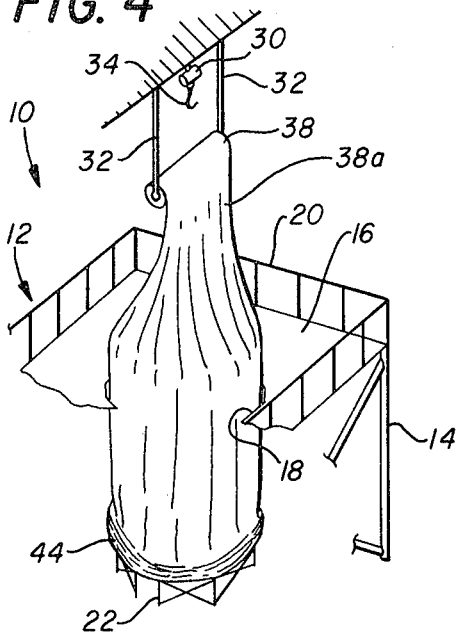

Referring to FIGS. 3 and 4, the tubular materials from rolls 36 and 38 are then manually threaded about feed wheels 26. Material **36*a* from lower roll 36 is extended upward through frame 24 and wheels 26. In accordance with the preferred construction of apparatus 10, a circular ring 40 is suspended by cables 42 within frame 24 and between feed wheels 26 and supply roll 36 to guide material 36*a*. Material 36*a* is then turned outwardly over wheels 26 as shown in FIG. 3. Material 38*a* is next drawn downwardly from supply roll 38 and manually positioned over material 36*a* about feed wheels 26 as shown in FIG. 4**.

The diametric sizes of tubular materials **36*a* and 38*a* are dimensioned to fit snugly about feed wheels 26 so that the materials can be advanced thereby in unison downwardly around frame 24 and through opening 18 in platform 12 to form a two-ply bag 44, which is collected on table 22. The liner of bag 44 thus comprises material 36*a*, with the outer layer thereof comprising 38*a***.

Figure 5:
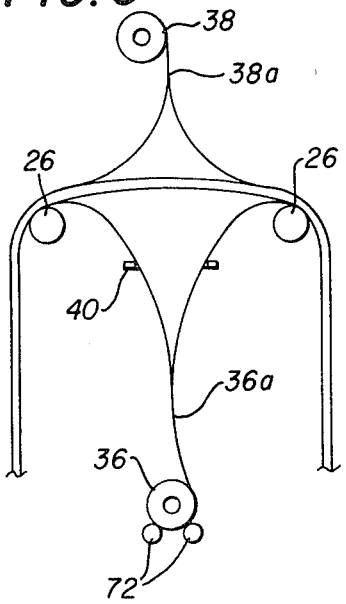
FIG. 5 is a schematic diagram illustrating the feed paths of the tubular materials utilized in practicing the invention.

FIG. 5 comprises a schematic diagram showing the placement of supply rolls 36 and 38 and the feedpath of materials **36*a* and 38*a* around feed wheels 26 to form agricultural storage bag 44**.

Figure 6:
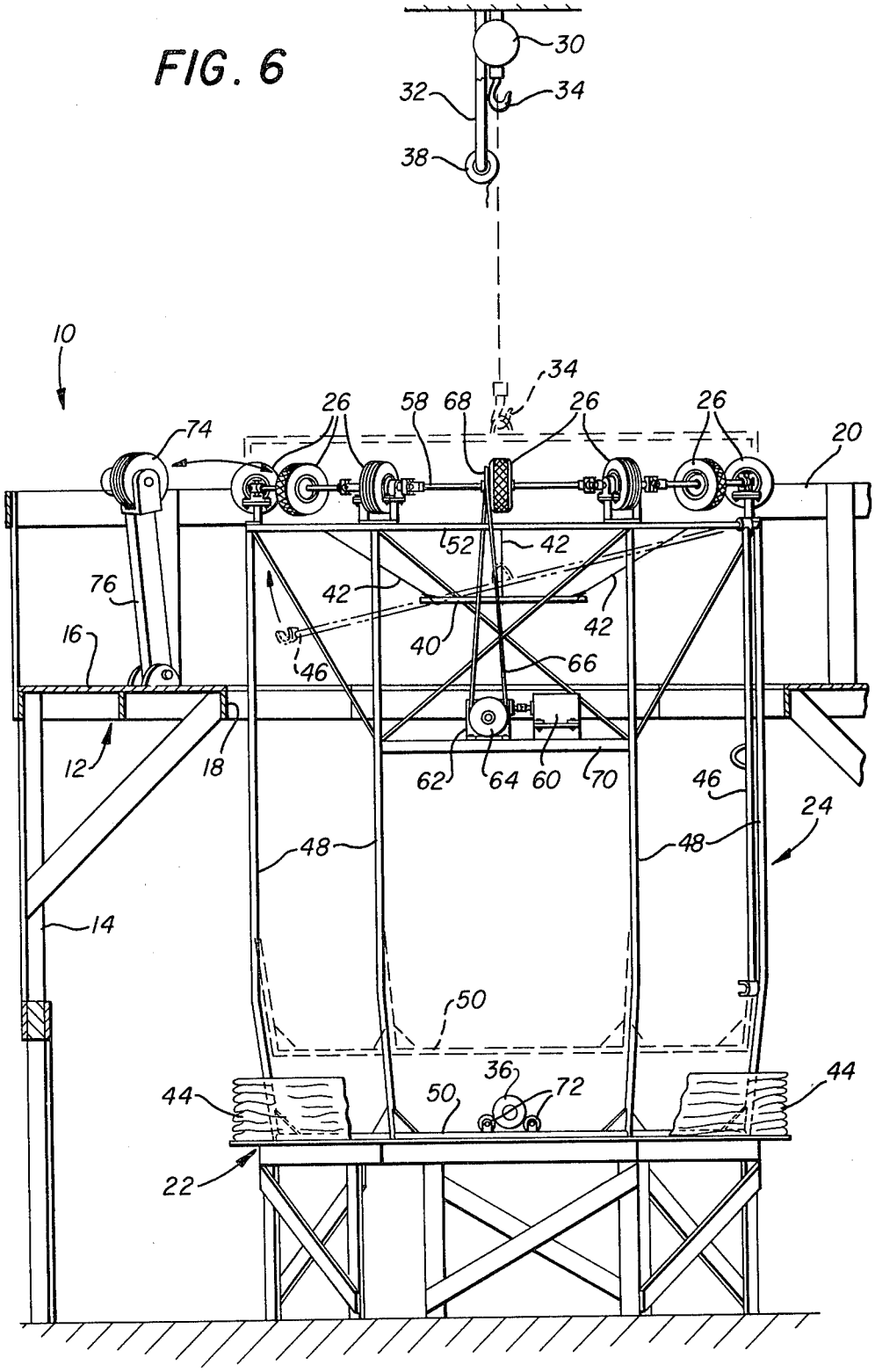
FIG. 6 is an enlarged side view of the apparatus incorporating the invention.

FIG. 6 best shows the bag 44 collected on table 22 around the lower end of frame 24. Bag 44 is thus shaped like a doughnut and comprised of inner layer of material **36*a* and outer layer of material 38*a*, which layers are collapsed about frame 24. If desired, bag 44 can be secured in this collapsed condition by strings (not shown) before frame 24 is lifted with winch 30 to permit removal of the bag. In accordance with the preferred construction, a pivotal bar 46 is provided on frame 24 for connection to the hook 34 of winch 30 so that the cage can be lifted away from bag 44 to the position shown in phantom lines in FIG. 6. If desired, frame 24 can rest directly on the floor instead of table 22, but use of the table is preferred because removal of bag 44 is facilitated thereby. After removal of bag 44, supply rolls 36 and 38 can be replenished to ready apparatus 10** for preparation of another two-ply agricultural storage bag.

Figure 8:
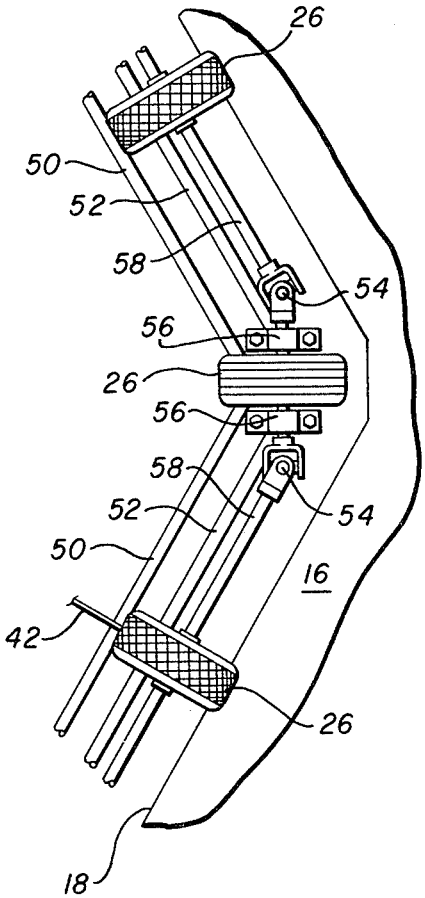
FIG. 8 is an enlarged view of a portion of FIG. 7.
Figure 7:
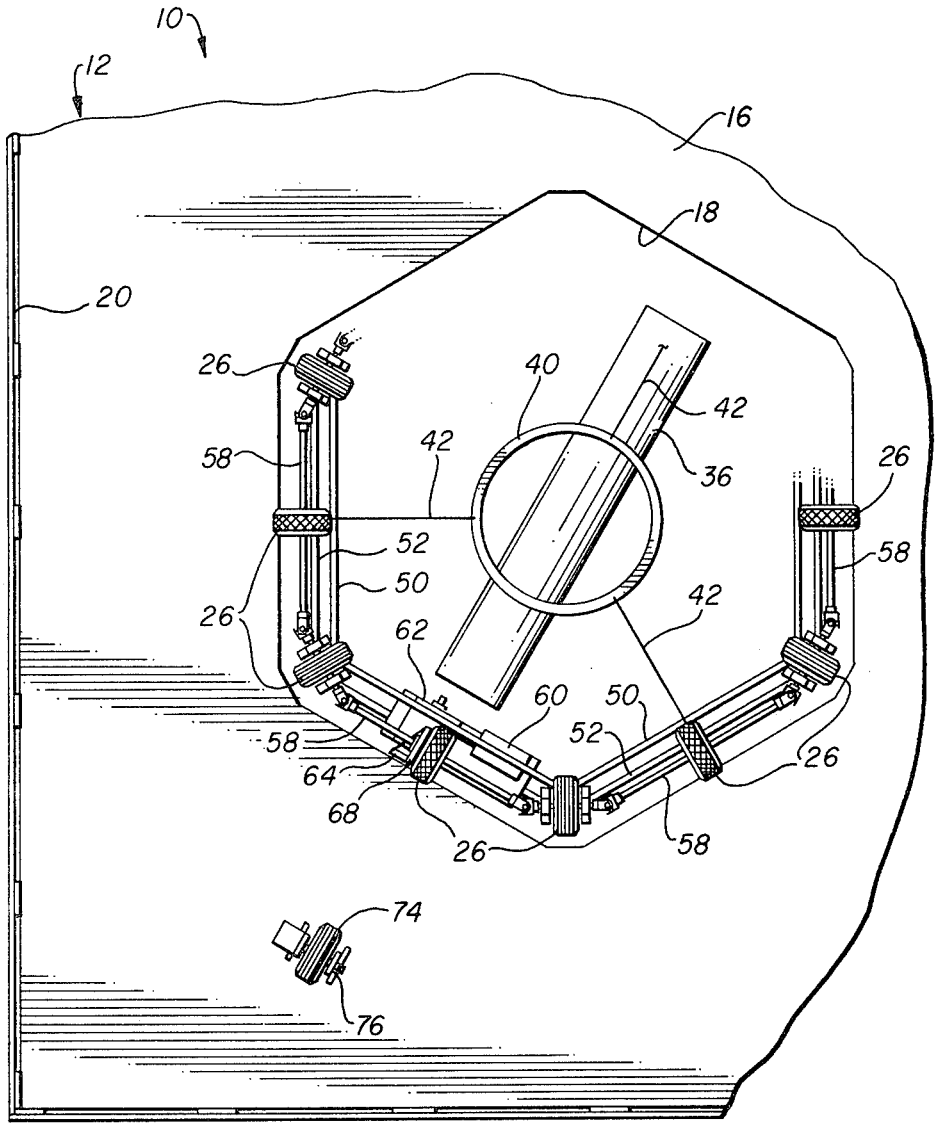
FIG. 7 is a top view of FIG. 6.

Additional constructional details of apparatus 10 can be seen in FIGS. 6–8. Frame 24 includes a plurality of vertical members 48 having inwardly angled lower ends interconnected by bottom horizontal members 50. The top ends of vertical members 48 are interconnected by upper horizontal members 52.

The corner wheels 26 are secured to shafts having U-joints 54 at the ends thereof and supported by bearings 56 mounted on upper horizontal members 52. Shafts 58 supporting the remaining feed wheels 26 are coupled between U-joints 54. As is best shown in FIG. 6, a motor 60 is drivingly connected to one of the shafts 58 through a speed reducer 62, drive pulley 64, belt 66 and driven pulley 68. Motor 60 and speed reducer 62 are supported by a cross member 70 extending between an adjacent pair of vertical members 48 in frame 24. Motor 60 is preferably of the electrical type, and is connected to a suitable source of power through a switch (not shown) for selectively driving all of the feed wheels 26.

In accordance with the preferred construction, a pair of spaced apart, elongate rollers 72 are provided on table 22 for supporting lower supply roll 36 during fabrication of an agricultural storage bag. Alternatively, the lower roll 36 can be supported on an arbor shaft (not shown) mounted in frame 24 or on table 22, as desired.

An optional measuring wheel 74 can be utilized with apparatus 10 for measuring the length of materials advanced from supply rolls 36 and 38. Wheel 74 is coupled to a suitable transducer (not shown) and is mounted at the end of a pivotal leg 76 attached to platform 12 for selective nipping engagement with one of the feed wheels 26. Materials 36*a* and 38*a* can thus be monitored during feeding, interrupted and circumferentially severed so as to cut agricultural bag 44 to a preselected length.

From the foregoing, it will be understood that the present invention comprises an apparatus and method for manufacturing two-ply bags which incorporates numerous advantages over the prior art. One significant advantage is that extremely long, two-ply agricultural storage bags can be formed with an apparatus of relatively compact size and noncomplex construction. Another significant advantage is that the manufacturing method herein is suited to the use of readily available tubular material in roll form. Other advantages of the invention will readily suggest themselves to those skilled in the art.

Although preferred embodiments of the invention have been illustrated in the accompanying Drawings and described in the foregoing Detailed Description, it will be understood that the application is not limited to the embodiments disclosed, but is intended to embrace any alternatives, modifications, rearrangements, and substitutions of parts and/or elements as fall within the spirit and scope of the invention.

We claim:

1. A method of manufacturing an agricultural storage bag, comprising the steps of:

providing first and second supplies of flexible tubular material located on opposite sides of a ring member with a frame extending to a table on the side of the ring on which the first supply is located;

extending tubular material from the first supply through the inside of the frame and the center of the ring member;

turning the tubular material from the first supply outwardly around the ring member;

extending tubular material from the second supply about the outside of the ring member and over the tubular materials from the first supply turned therearound;

simultaneously advancing tubular materials from the first and second supplies over the ring member and outside of the frame;

collecting the tubular materials in a folded condition and in an annular configuration against the table;

measuring the length of the first and second tubular materials as they are advanced;

interrupting advancement of the first and second tubular materials responsive to a predetermined length of said materials having been advanced;

circumferentially cutting said first and second tubular materials to form a two-ply storage bag of preselected length; and thereafter separating the frame from the table to permit removal of the folded two-ply storage bag.

2. The method of claim 1, wherein the first and second flexible tubes are formed of plastic materials.

3. The method of claim 1, wherein the ring member is comprised of a plurality of selectively driven rollers, and wherein the step of simultaneously advancing the first and second tubes is carried out by said rollers.

4. The agricultural bag formed according to the method of claim 1.

5. Apparatus for manufacturing agricultural storage bags, which comprises:

structure defining an elongate frame with upper and lower ends;

a plurality of wheels rotatably supported in circular arrangement about said frame structure near the upper end thereof;

base means positioned adjacent said frame structure at the lower end thereof;

means for supporting first and second supplies of flexible tubular material on opposite sides of said wheels;

the tubular materials from said first supply extending upwardly through said frame structure and outwardly around said wheels, with the tubular materials from the second supply extending downwardly in surrounding engagement about said wheels and over the tubular material from said first supply; and means for selectively affecting rotation of said wheels to simultaneously advance the tubular materials around said frame structure to fold against the base means such that a seamless two-ply agricultural bag is collected at the lower end of said frame structure on the base means;

means for selectively separating said frame structure and said base to permit removal of the bag from the lower end of said frame structure;

means for measuring the length of the first and second tubular materials as they are advanced;

means for interrupting advancement of the first and second tubular materials responsive to a predetermined amount of said materials having been advanced; and means for circumferentially cutting said first and second tubular materials to form a folded two-ply storage bag of preselected length.

6. The apparatus of claim 5, including:

a circular guide member mounted within said frame structure, the tubular material from said one supply extending therethrough and then outwardly around said wheels.

7. The apparatus of claim 5, including:

a platform surrounding said frame structure, said platform including a deck having an opening therein with said frame structure extending through said opening.

* * * * *